United States Patent [19]

Berkelder

[11] Patent Number: 4,565,523

[45] Date of Patent: Jan. 21, 1986

[54] GAS BURNER

[75] Inventor: Wilhelm H. Berkelder, Aalten, Netherlands

[73] Assignee: Apparatenfabriek ATAG B.V., Netherlands

[21] Appl. No.: 493,949

[22] Filed: May 12, 1983

[30] Foreign Application Priority Data

May 24, 1982 [NL] Netherlands ..... 8202118

[51] Int. Cl.[4] ..... F23D 13/40

[52] U.S. Cl. ..... 431/354; 126/39 E; 239/396; 48/180 F

[58] Field of Search ..... 431/154, 353, 354; 126/39 E, 39 K; 239/390, 396; 48/180 P, 180 F

[56] References Cited

U.S. PATENT DOCUMENTS

| | | | |
|---|---|---|---|
| 670,740 | 3/1901 | Sheppard | 126/39 K |
| 3,822,982 | 7/1974 | DuPerow | 431/193 |
| 3,874,841 | 4/1975 | Ferlin | 126/39 E X |
| 4,243,176 | 1/1981 | Hays | 431/354 X |

FOREIGN PATENT DOCUMENTS

| | | | |
|---|---|---|---|
| 2456906 | 5/1979 | France . | |
| 636870 | 3/1962 | Italy | 431/354 |
| 1223005 | 2/1971 | United Kingdom . | |

*Primary Examiner*—Margaret A. Focarino

*Attorney, Agent, or Firm*—Birch, Stewart, Kolasch & Birch

[57] ABSTRACT

A gas burner for a domestic cooking apparatus comprising a gas feed tube, a mixing tube and a burner cover near the outlet of the mixing tube. An outlet member is provided in the form of an apertured flow plate which is connected to the gas feed tube in sealing relationship by way of an intermediate flexible ring. By exchanging the flow plate the burning capacity can be changed at the site of use.

2 Claims, 3 Drawing Figures

FIG.1
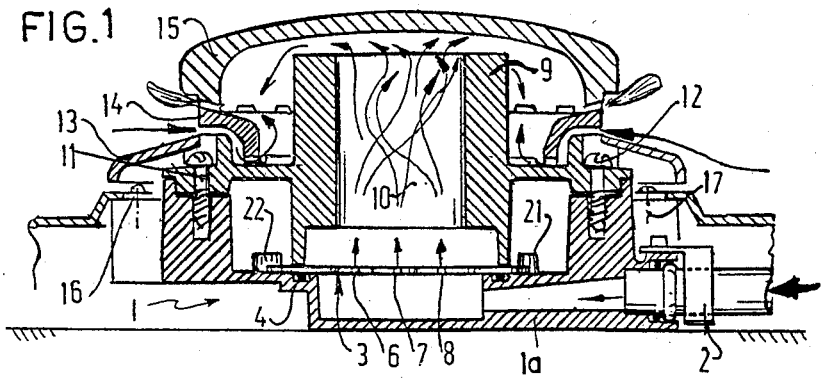
FIG.2
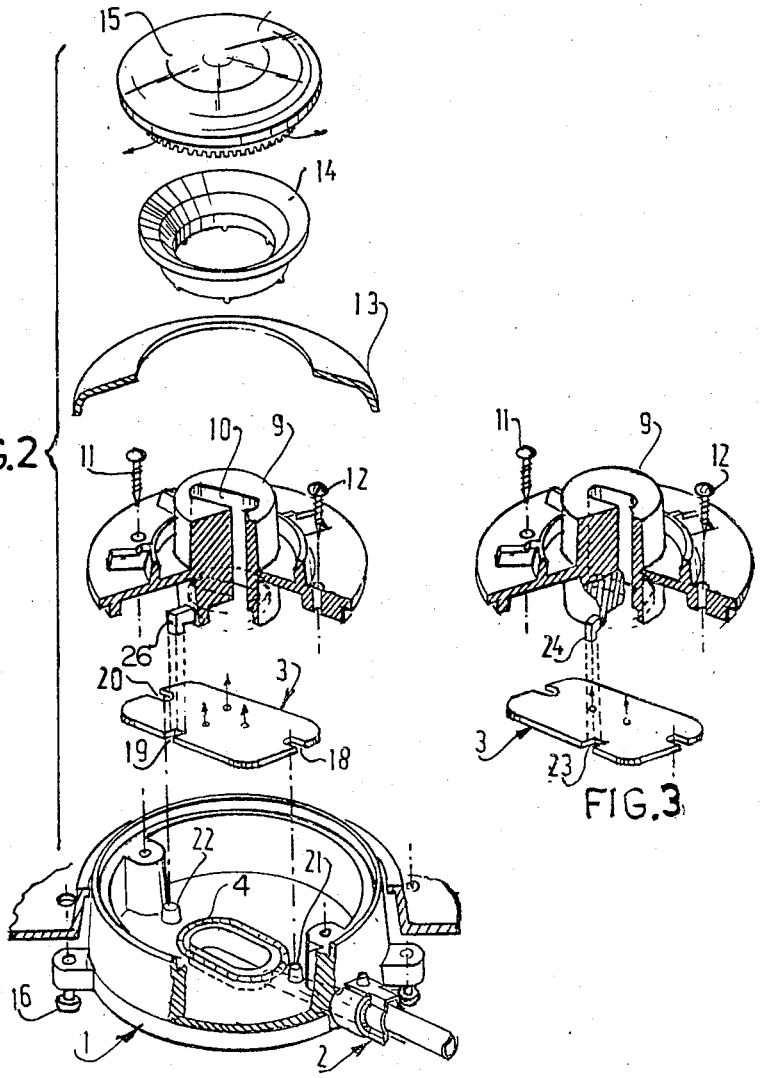
FIG.3

GAS BURNER

BACKGROUND OF THE INVENTION

The invention relates to a gas burner for use in a domestic cooking apparatus comprising a gas feed tube for introducing gas through an effluent member into a mixing tube and a burner cover near the outlet side of the mixing tube. With respect to dimensions gas burners are proportioned to the burner capacity. This depending upon the burner capacity for each type of gas burner, different sized components have to be manufactured and stocked. At the site of use, the burner capacity can only be changed by removing the whole burner and replacing it by another gas burner having a different capacity. This known practice is inconvenient because the production and storing of components are relatively expensive.

SUMMARY OF THE INVENTION

The invention has for its object to obviate these disadvantages and to provide a gas burner, having a great many component parts which are independent of the burner capacity.

According to the invention this is achieved in providing an effluent member shaped in the form of a releasable apertured flow plate covering the gas feed tube. In this way a universally usable burner holder is obtained in the form of a gas feed tube, the outlet side of which is closed by an exchangeable flow plate embodying the invention. When changing the burner capacity, the burner holder, inclusive of a gas feed tube, can be maintained and it is only necessary to replace the flow plate, with the mounting part of the burner comprising the mixing tube and the burner cover. The choice of the burner capacity can be made at the site of use, since the manipulations described above are quite simple. In order to simplify mounting, the flow plate is preferably connected by means of a clamping joint with the intermediary of a flexible ring with the gas feed tube. Thus, by removing a few bolts the flow plate can be removed in a simple manner.

With a given type of flow plate is associated a given type of mixing tube. In order to avoid an unintentional combination of a mixing tube with a non-matching type of flowplate, the flow plate and the mixing tube are provided with relatively cooperating extensions and recesses. It is thus ensured that for a given flow plate, the matching type of mixing tube will always be used. The size, place and number of extensions and recesses depend on the burner capacity. A further simplication is obtained in that the mixing tube has only one flow channel. The number, the place and the size of the apertures in the flow plate depend on the burner capacity.

BRIEF DESCRIPTION OF DRAWINGS

The invention will be described more fully with reference to the accompanying drawings.

FIG. 1 is a sectional view of the burner embodying the invention,

FIG. 2 is the burner of FIG. 1, the component parts being and disassembled, FIG. 3 is a mixing tube with a flow plate of a capacity differing from that of FIG. 2.

The gas burner embodying the invention comprises a burner holder including a gas feed tube 1*a*, which is connected through a clamping joint with the gas duct 2. The outlet side of the gas feed tube 1*a* is provided with a flow plate 3, which is clamped in sealing relationship to the burner holder 1 by means of the bolts 11,12 with the interposition of a flexible ring 4. The flow plate 3 has apertures 6,7 and 8, dependent on the desired burner capacity. On the burner holder 1 is disposed a mixing tube 9, which has only one flow channel 10. By means of the screws 11 and 12 the mixing tube 9 is fastened to the burner holder 1. With the mixing tube 9 are connected the burner cup 13, the auxiliary gas ring 14 and the burner cover 15. In the gas burner embodying the invention the burner cup 13 has the shape of an enamelled ornamental plate, which serves to cover the air stream apertures. The assembly is fastened by means of bolts 16 and 17 to the frame of the cooker.

The flow plate 3 has recesses 18,19 and 20, the recesses 18 and 20 co-operating with centering lugs 21 and 22 respectively and the recess 19 cooperating with an extension 26 on the mixing tube 9. The placement of the recess 19 and of the extension 26 respectively depends on the desired burner capacity. In the design shown in FIG. 3 the placement of the recess 23 is shifted with respect to the recess 19 of FIG. 2. This also applies to the extension 24 on the mixing tube of FIG. 3. It is in this way guaranteed that the desired flow plate will invariably be used with the matching mixing tube.

In the gas burner embodying the invention the burner holder inclusive of the gas feed tube 1 can be a universally applicable component while also the diameter of the opening in the collecting dish is independent of the load. In dependence on the burner capacity a matching flow plate 3 and the associated mixing tube 9 are mounted in the burner holder. Thanks to the screw joints 16,17 and 11,12 mounting can be readily carried out.

I claim:

1. A gas burner for use in a domestic cooking apparatus comrpising in combination:

a burner holder including a gas feed tube;

an interchangeable flow plate having apertures therein, the number of apertures being determined by the desired capacity of the burner, said flow plate comprising recesses for regulating the positioning of said flow plate with respect to said burner holder;

a flexible ring provided as a seal between said flow plate and said burner holder;

an associated mixing tube having respective inlet and outlet portions in which air is mixed with gas, said mixing tube comprising an extension connecting with a corresponding recess of said flow plate; and a burner cover provided at the outlet of said mixing tube said flow plate and mixing tube being a matched pair whereby the capacity of said gas burner can be readily varied by changing both said flow plate and mixing tube by the substitution of the appropriate flow plate and cooperating mixing tube.

2. The gas burner of claim 1 characterized in that said mixing tube has a single flow channel.

* * * * *